US009121269B2

(12) United States Patent
Longfellow et al.

(10) Patent No.: US 9,121,269 B2
(45) Date of Patent: Sep. 1, 2015

(54) VORTEX PLUNGER ARRANGEMENT

(71) Applicants: Neil W. Longfellow, Boulder, CO (US); David A. Green, Highlands Ranch, CO (US); Robert E. Bender, Evergreen, CO (US)

(72) Inventors: Neil W. Longfellow, Boulder, CO (US); David A. Green, Highlands Ranch, CO (US); Robert E. Bender, Evergreen, CO (US)

(73) Assignee: Well Master Corp, Golden, CO (US)

( * ) Notice: Subject to any disclaimer, the term of this patent is extended or adjusted under 35 U.S.C. 154(b) by 0 days.

(21) Appl. No.: 13/999,272

(22) Filed: Feb. 4, 2014

(65) Prior Publication Data

US 2014/0326451 A1 Nov. 6, 2014

Related U.S. Application Data

(63) Continuation-in-part of application No. 13/506,464, filed on Apr. 20, 2012, now Pat. No. 8,869,902, which is a continuation-in-part of application No. 13/374,830, filed on Jan. 17, 2012, now Pat. No. 8,863,837, and a continuation-in-part of application No. 12/586,736, filed on Sep. 25, 2009, now Pat. No. 8,201,629, and a continuation-in-part of application No. 12/460,099, filed on Jul. 14, 2009, now Pat. No. 8,162,053, and a continuation-in-part of application No. 12/217,756, filed on Jul. 8, 2008, now Pat. No. 7,793,728, and a continuation-in-part of application No. 11/715,216, filed on Mar. 7, 2007, now Pat. No. 7,748,448, which is a continuation of application No. 11/350,367, filed on Feb. 8, 2006, now Pat. No. 7,395,865.

(60) Provisional application No. 60/593,914, filed on Feb. 24, 2005.

(51) Int. Cl.

| | |
|---|---|
| ***E21B 17/10*** | (2006.01) |
| ***E21B 43/12*** | (2006.01) |
| ***E21B 47/01*** | (2012.01) |
| ***F04B 47/12*** | (2006.01) |

(52) U.S. Cl.

CPC ..... *E21B 43/121* (2013.01); *E21B 47/01* (2013.01); *F04B 47/12* (2013.01)

(58) Field of Classification Search

CPC ..... E21B 43/00; E21B 33/12
USPC ..... 166/372, 105
See application file for complete search history.

(56) References Cited

U.S. PATENT DOCUMENTS

| | | | | |
|---|---|---|---|---|
| 4,467,879 | A * | 8/1984 | Burge | 175/325.4 |
| 4,554,130 | A * | 11/1985 | Ecer | 419/8 |
| 5,660,534 | A * | 8/1997 | Snow | 417/554 |
| 2005/0056416 | A1 * | 3/2005 | Gray et al. | 166/68.5 |

(Continued)

*Primary Examiner* — Cathleen Hutchins
*Assistant Examiner* — Ronald Runyan
(74) *Attorney, Agent, or Firm* — Don Halgren

(57) ABSTRACT

A plunger assembly arranged to minimize uneven wear spots thereon during the plunger assembly's horizontal and vertical travel within a hydrocarbon producing well conduit. The plunger assembly comprises an elongated central mandrel having a bore extending longitudinally therethrough for transmitting gaseous fluids from a well, through the plunger assembly, a pair of longitudinally spaced-apart sets of arcuately shaped wear pads guidably supported on outer portions of the elongated central mandrel, and at least one tangentially directed nozzle arranged to direct gaseous fluids from the bore of the elongated central mandrel against an inner side of at least one of the arcuately shaped wear pads arranged on the outer portions of the elongated central mandrel.

14 Claims, 6 Drawing Sheets

(56) References Cited

U.S. PATENT DOCUMENTS

2008/0185141 A1* 8/2008 Amies et al. ..... 166/105
2009/0272519 A1* 11/2009 Green et al. ..... 166/66
2010/0252274 A1* 10/2010 Buytaert et al. ..... 166/380
2011/0042069 A1* 2/2011 Bailey et al. ..... 166/244.1

* cited by examiner

VORTEX PLUNGER ARRANGEMENT

FIELD OF THE INVENTION

This present application relates to plunger lift systems for oil and gas wells, and more particularly to a gas lift plunger with an improved assembly arrangement to facilitate liquid removal from inclined, S-shaped and or horizontal wells, and is a continuation-in-part of Ser. No. 13/506,464, filed on Apr. 20, 2012, which is a continuation-in-part application of Ser. No. 13/374,830, filed Jan. 17, 2012 and is a continuation-in-part application of Ser. No. 12/586,736, filed Sep. 25, 2009, now U.S. Pat. No. 8,201,629, issued 19 Jun. 2012, and of Ser. No. 12/460,099, now U.S. Pat. No. 8,162,053, issued 24 Apr. 2012, which is a re-filing of Ser. No. 12/313,279, and is a continuation-in-part application of Ser. No. 11/715,216, now U.S. Pat. No. 7,748,448, issued 6 Jul. 2010 and also of Ser. No. 12/217,756, now U.S. Pat. No. 7,793.728, issued 14 Sep. 2010, which is a continuation of Ser. No. 11/350,367, now U.S. Pat. No. 7,395,865 which was based upon Provisional Patent Application 60/593,914, filed 24 Feb. 2005, each of which is incorporated herein by reference in its entirety.

BACKGROUND OF THE INVENTION

Discussion of the Prior Art

Directional drilling is a term to describe drilling of an oil or gas well such that the conduit to the producing zones may be reached more directly, more effectively and wherein such zones reached will be more productive. Directional drilling permits a multitude of wells to be drilled from a single "pad" to their endpoints deep in the ground and conform to well spacing requirements and regulations with minimal disturbance to the surface environments. In these cases, the well bore may take on sort of an "S" shape to reach a target endpoint which is likely offset from the drill site.

In other instances, directional drilling is used to drill the well bore to a desired depth, then steer the well bore to follow along a lateral path through a producing geologic formation. This is commonly referred to as a "Horizontal" well.

Well plungers have been utilized for many years in the recovery of gas and oil from vertical wells for the removal of liquids and to facilitate both hydrocarbon gas and liquid extraction from those wells. Plungers utilized in non-vertical and horizontal wells frequently encounter a wear problem, because the non-vertical portion of the well conduit may effect premature wear on one side portion of the plunger. A typical prior art plunger may thus have a wear spot on an underside thereof. Such wear spot disposed along its longitudinal axis will minimize the sealing capacity of the plunger within the well conduit, leaving fluid in the well which would have been lifted had the plunger remained round and not worn unevenly. After time the unevenly worn plunger will preferentially lie in the same axial orientation as it moves through the tubing string causing flattening of its underside due to increased friction between the plunger and the tubing wall as more of the weight of the plunger is brought to bear on one side of the plunger during its travel.

It is thus an object of the present invention to overcome the disadvantages of the prior art.

It is a further object of the present invention to provide a plunger arrangement which will function properly in both vertical and horizontal portions of a hydrocarbon well system.

It is a still further object of the present invention to provide a plunger system to handle curves and angles as typically found in horizontal wells and pad drilled "S" shaped wells without undue wearing or loss of plunger efficiency.

BRIEF SUMMARY OF THE INVENTION

The present invention comprises a split pad plunger for use in hydrocarbon wells, particularly those wells producing natural gas as the primary product. The split pad plunger assembly of the present invention is utilized to physically travel up and down between the top of the well to the bottom of the well and also travel any non vertical or horizontal conduits of that well and back to drive the bulk of the liquid present in its travel conduit, to the surface.

The plunger assembly is comprised of an elongated hollow central core mandrel. The hollow central elongated core mandrel consists of an elongated partially hollow first or front upper half and elongated fully hollow second back (lower) half with a bore extending therethrough. Each front half and the back half, at least in one preferred embodiment is preferably a duplicate of portions of the other half. The bore in one preferred embodiment is of uniform diameter along the length of its elongated longitudinal axis "L". The bore extending through the mandrel in another preferred embodiment may be of tapered configuration. The taper of the bore would preferably be often narrowing diameter as the bore extends from the bottom of lower barrel and the plunger assembly towards the top or upper end thereof. The bore in a further embodiment may be comprised of one more pinched a narrowed diameter sections to have a venturi-like fluid flow effect on fluids passing through that bore.

The elongated hollow mandrel has a mid-portion with an annular circumferential securement ring ridge disposed centrally therearound. Each half of the mandrel has at least two sets of longitudinally spaced-apart radial arrays of supports.

A cylindrically shaped "retrieval-neck" is threadedly arranged longitudinally outwardly of the distalmost annular array of supports at the upper or top end of the plunger assembly. A hollow barrel is threadedly received onto the lower or downwardly facing end of the plunger assembly. The retrieval neck preferably has a threaded bore extending therein which threadedly receives the screw threaded distal end of the central spine or mandrel. In a further embodiment, the retrieval neck is machined as part of a solid casting with the mandrel, and is irremovable therefrom. The hollow lower end barrel has a channel extending therethrough, to permit gaseous fluids to enter the bore within the mandrel.

Relative to the "wear functions" of the plunger assembly, an arrangement of, for example, preferably at least two outer-surface-curved sealing-surface wear pads are circumferentially arranged about each mandrel half, so as to be radially slidingly supported adjacent the radially outer end of each radially directed support. The outer-surface curved sealing surface pads in one preferred embodiment are of "overall" parallelogram configuration when viewed from a radially adjacent perspective.

The circumferentially adjacent parallelogram configuration sealing-surface wear pads thus create a narrow, spin-inducing (to the plunger) spiral gap between one another. Each wear pad in another aspect of the present invention, may have its radially inner surface configured to preferentially direct flow of pressurized gas, from the inner bore of the plunger, outwardly from the gaseous jets, to one side of the respective wear pads, to effect additional rotational motion upon the plunger in its travels.

The curved sealing surface pads in another preferred embodiment are of rectilinear configuration. The curved sealing-surface pads each have a cutout arranged on its longitudinally directed edges (ends). Each cutout slidingly mates with the radially directed support. At least one radial bias spring is arranged between the central spine or mandrel adjacent each radially directed support. The radial bias springs act to radially outwardly bias the curved sealing surface pads against the inner side of the well's conduit in which the split-pad plunger assembly travels in addition to the bias effected by the gaseous jets therebeneath. The outward radial bias of the sealing-surface pads acts to minimize loss of pressure from the lower side and/or loss of fluid from the upper side of that conduit during movement of the plunger therein.

The elongated mandrel comprises an annular manifold with a discharge circuit arranged circumferentially around at least one longitudinal location of preferably both the first half and the second half of the hollow elongated mandrel. Such a manifold has a plurality of fluid discharge conduits or nozzles or jets preferably arranged generally tangentially therein, with respect to the bore within the barrel of the mandrel. Such tangential orientation of these nozzles thus induces rotation to the entire plunger assembly when gas from the well is introduced through the bore of the mandrel and onto/against the inner side of the wear pads. The pressure driven gas bubbles through gaps between the wear pads and escapes into the well conduit ahead of the plunger, inducing turbulence effecting plunger/well seal properties, and lightening its fluid load on top of the plunger, so less pressure is required to lift a give amount of fluid.

In yet a further embodiment, such conduit or nozzles may also be slightly rearwardly directed towards the lower or bottom end of the plunger assembly to provide a slight additional thrust for forward advancement of the plunger assembly.

The gaseous fluid "G" thus entering the bore in the hollow lower end of the mandrel barrel pressurizably flows into the fluid communicative bore of the mandrel, and through the nozzles in the manifold, as the plunger assembly travels within the conduit "C" of the well. The jet-like fluid pressure of the well gaseous fluids traveling through the first lower bore in the hollow lower end barrel and into the bore within the elongated mandrel flows tangentially (along with a radial component) outwardly through the channels and nozzles in the manifold, angularly against the arcuate inner surface of the pads pushing them against the walls of the conduit "C", assisting the springs on the elongated mandrel thereby. This outwardly directed bias force provides both an angular momentum and an improved sealing of the plunger assembly as it travels through the well's conduit "C". Further, the gaseous fluid escapes radially outwardly from within the plunger assembly, and into the conduit "C", keeping liquid from running back downhole via movement under the pads, and also helps keep the liquid on the top (above) and ahead of the plunger. That escaping gas thus also aerates and lightens the liquid load on above the plunger assembly, so less pressure is required to provide lift to a given amount of fluid above the plunger assembly. The biasing of the well gas "G" against the curved inside surface of the pads assists the springs in biasing the pads radially outwardly against the conduit "C", thus providing a tighter seal between the plunger assembly and the conduit "C" through which it is moving.

Thus, gaseous fluids "G" enter the lower end of the plunger assembly through the central open channel in the hollow lower end barrel and into the main channel, the bore within the mandrel. The gas "G" enters the manifold and exits out the tangentially directed nozzles therein, and jets against the inner surface of the pads, biasing them radially outwardly, assisting the bias springs thereby, and providing spin to the plunger assembly. The gas "G" then also enters the conduit "C" and floats upwardly therein, aerating lightening the load of the liquid on top of the plunger assembly, minimizing liquid escaping into the plunger assembly and minimizing liquid passage downwardly into the conduit "C".

The invention thus comprises a plunger assembly arranged to minimize uneven wear spots thereon during the plunger assembly's horizontal and vertical travel within a hydrocarbon producing well conduit, the plunger assembly comprising: an elongated central mandrel having a bore extending longitudinally therethrough for transmitting gaseous fluids from a well, through the plunger assembly; a plurality of arcuately shaped wear pads guidably supported on outer portions of the elongated central mandrel; and at least one tangentially directed nozzle arranged to direct gaseous fluids from the bore of the elongated central mandrel against an inner side of at least one of the arcuately shaped wear pads arranged on the outer portions of the elongated central mandrel. The wear pads are preferably of a rectilinear configuration shape. The wear pads are preferably of four sided shape of a parallelogram configuration. The at least one tangentially directed nozzle may also rearwardly directed thrust producing orientation. The wear pads have a gap or space therebetween. The gap or space between adjacent wear pads preferably defines a spirally shaped opening therebetween. The spiral gaps and the conduits or nozzles are arranged to effect a rotation of the plunger assembly about a longitudinal axis thereof in its movement through a well conduit.

The invention also comprises a method of inducing rotation of a plunger assembly during the plunger assembly's movement through a conduit in a hydrocarbon well, comprising: arranging an elongated central mandrel having a bore extending longitudinally therethrough for transmitting gaseous fluids from a well, through the plunger assembly; arranging a plurality of arcuately shaped wear pads guidably supported on outer portions of the elongated central mandrel; and forming at least one tangentially directed conduit or nozzle in the elongated central mandrel, the conduit or nozzle being arranged to direct gaseous fluids from the bore of the elongated central mandrel against an inner side of at least one of the arcuately shaped wear pads arranged on the outer portions of the elongated central mandrel.

The method may include forming the at least one tangentially directed conduit or nozzle in the elongated central mandrel in a rearwardly direction in addition to its tangential direction; arranging the plurality of wear pads on the outside of the elongated central mandrel with adjacently arranged gaps or spaces therebetween; arranging the gaps or spaces into a spiral configuration with respect to a longitudinal axis of the plunger assembly.

The invention also includes a system for reducing the wear spots on any one of a plurality of wear pads circumferentially arranged on an outer surface of a plunger assembly in an "S" shaped or horizontally oriented hydrocarbon retrieval well operation, the system comprising: an elongated central mandrel of the plunger assembly having a bore extending longitudinally therethrough for transmitting gaseous fluids from a well, through the plunger assembly; a plurality of arcuately shaped circumferentially adjacent wear pads guidably supported on outer portions of the elongated central mandrel of the plunger assembly; and at least one tangentially directed nozzle arranged to direct gaseous fluids from the bore of the elongated central mandrel against an inner side of at least one of the arcuately shaped wear pads arranged on the outer portions of the elongated central mandrel, so as to induce a spin or rotation of the plunger assembly about its longitudinal axis and thus reduce wear spots on any one wear pad. The wear pads are preferably of a parallelogram shape having a spiral-like gap between circumferentially adjacent wear pads. This gap between the circumferentially adjacent wear pads is of rotational inducing spiral orientation to the plunger assembly. The at least one tangentially directed nozzle may also have a rearward slant or orientation thereto to induce thrust as well as rotation into the plunger assembly, wherein any gas from the at least one nozzle escapes from the plunger assembly by passage between the adjacent spaced apart wear pads.

The invention also comprises a plunger assembly arrangement for the minimization of wear spots thereon during its travel through a conduit of a hydrocarbon recovery operation in a well, comprising: an elongated central mandrel having an elongated pressurized gas transmitting bore extending at least partially therethrough; an arrangement of wear pads arranged on an outer side of the elongated central mandrel; at least one tangentially arranged conduit or nozzle extending from the bore to the outer side of the central mandrel so as to induce rotation of the plunger assembly during the travel of the plunger assembly through the conduit of the well. The wear pads are preferably of spin inducing parallelogram configuration. The conduit or nozzle is arranged to direct gas against an inner side of the arrangement of wear pads to facilitate pressure of the wear pads against the conduit of the well. The conduit or nozzle arrangement from the bore to the wear pads also has a rearward orientation to induce a thrust component into the plunger assembly.

The invention also comprises a system for minimizing uneven wearing of an annular array of radially displaceably biased wear pads arranged about an elongated, central, hollow-bore gas-transmitting mandrel of a plunger assembly as that plunger assembly travels through a conduit in a hydrocarbon recovery well, the system comprising: at least one gas ejection conduit obliquely arranged between the hollow bore of the central mandrel and an outer surface thereof so as to eject gaseous fluids onto an inner surface of at least one wear pads, so as to bias that at least one wear pad outwardly, and to induce rotation of the plunger assembly within the conduit of the well. The gas ejection conduit is preferably arranged tangentially with respect to the hollow-bore gas-transmitting mandrel. The annular array of radially displaceable wear pads preferably have a gap therebetween to permit gas from the gas ejection conduit to escape outwardly of the plunger assembly, to lighten any load of fluid ahead of the plunger assembly within the conduit of the well. Each wear pad in the annular array of wear pads preferably has the shape of a parallelogram. In a further aspect of the present invention, each wear pad may have an inner surface configured as to shape and circumferentially directed/reduced thickness or channel array so as to induce gas flow in a specific plunger-rotation-inducing direction. At least one of the wear pads preferably have tapering thickness in its circumferential direction for force generating flow of the gaseous fluids therepast. The inner surface of at least one of the wear pads preferably has spiral grooves arranged therein to facilitate gaseous movement and support plunger rotation.

BRIEF DESCRIPTION OF THE DRAWINGS

The objects and advantages of the present invention will become more evident, when viewed in conjunction with the following drawings, in which.

DETAILED DESCRIPTION OF THE PREFERRED EMBODIMENTS

Figure 1:
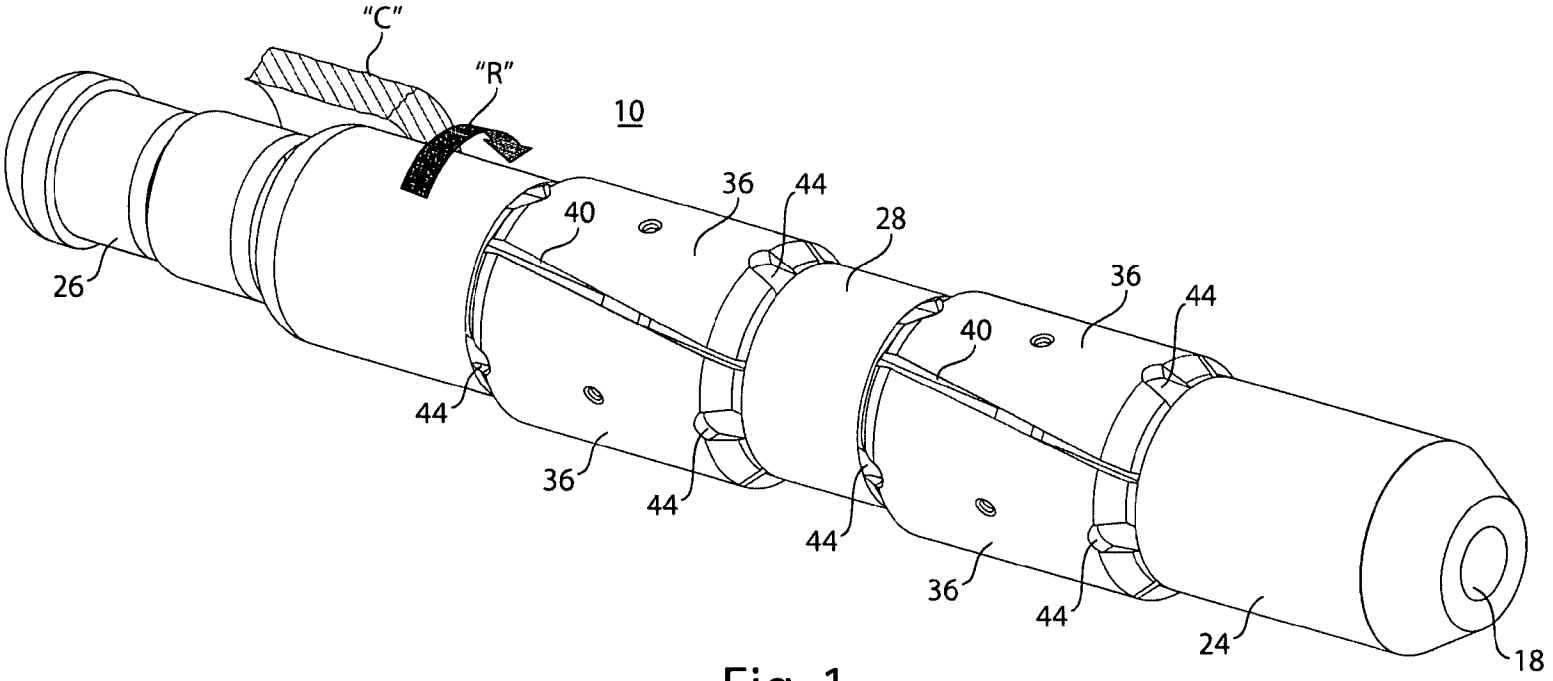
FIG. 1 is a perspective view of a vortex plunger in a conduit, the plunger constructed according to the principles of the present invention.

Referring now to the drawings in detail and particularly to FIG. 1, there is shown the present invention, in which a split pad plunger assembly 10 is displayed for use in hydrocarbon wells, particularly those wells producing natural gas as the primary hydrocarbon. The split pad plunger assembly 10 of the present invention is utilized to physically travel up and down between the top of the well to the bottom of the well and travel the non-vertical and horizontal conduits "C" of that well and back to drive the bulk of the liquid present in its travel conduit "C", to the surface.

Figure 2:
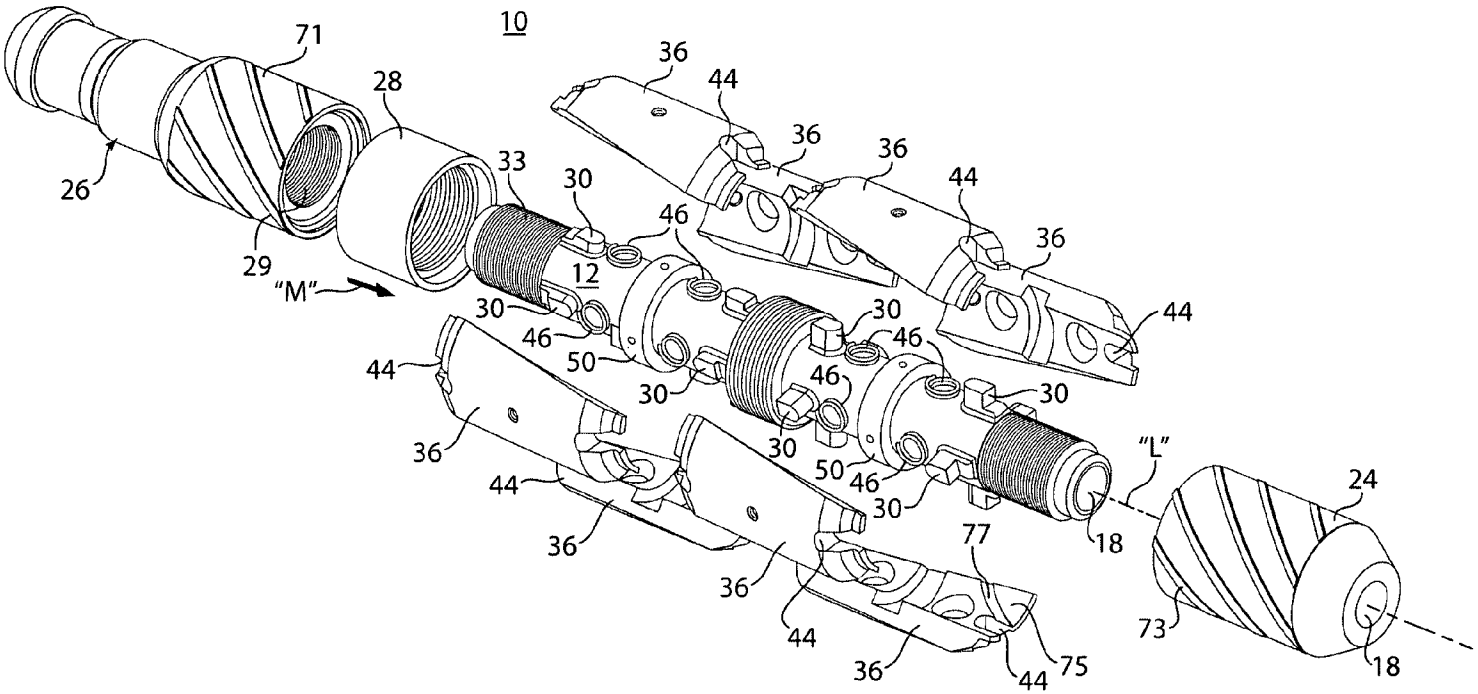
FIG. 2 is an exploded view of the perspective view of the vortex plunger shown in FIG. 1.
Figure 3:
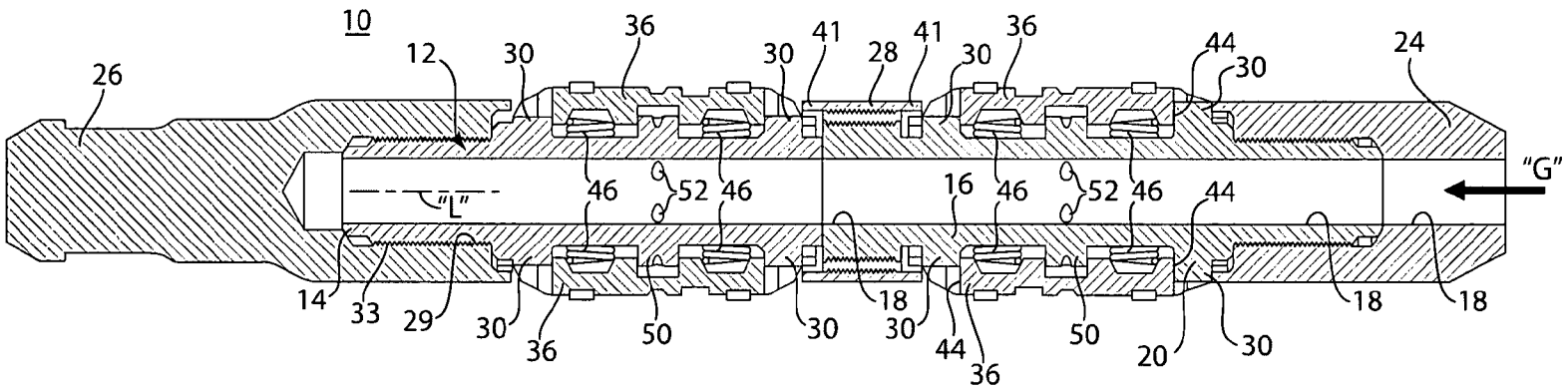
FIG. 3 is a longitudinal sectional view of the plunger shown in FIG. 1.

The plunger assembly 10, shown more explicitly in FIGS. 2 and 3, is comprised of an elongated hollow central core mandrel 12. The hollow central elongated core mandrel 12 consists of an elongated partially hollow first or front upper half 14 and a preferably integral elongated fully hollow second back (lower) half 16 with a bore 18 extending therethrough. Each front half 14 and the back half 16, at least in one preferred embodiment comprises duplicate mandrels 20 and 22. The bore 18 in one preferred embodiment is of uniform diameter along the length of its elongated longitudinal axis "L", and is represented as such in FIG. 3. The bore 18 extending through the duplicate mandrels 20 and 22 in another preferred embodiment may be of tapered configuration, not shown here for clarity of the figures. The taper of the bore 18 would preferably be often narrowing diameter as the bore 18 extends from the bottom of lower barrel 24 of the plunger assembly 10 towards the top or retrieval neck end 26 thereof. The bore 18 in a further embodiment may be comprised of one pinched in a narrowed diameter section to have a venturi-like fluid flow effect on fluids passing through that bore 18 at through-the-mandrel exit locations described further hereinbelow.

The elongated hollow mandrels 20 and 22 have a mid-portion with an annular circumferential-securement-ring 28 disposed centrally therearound, as represented in FIGS. 1 and 3, the ring 28 being shown in FIG. 2 before it is slid to the mid-point around the mandrel 12, as indicated by arrow "M". Each half 20 and 22 of the mandrel 12 has at least two sets of longitudinally spaced-apart radial arrays of pad supports 30, as shown in FIGS. 2, 3 and 4C.

A cylindrically shaped "retrieval-neck" 26 is threadedly arranged longitudinally forwardly of the distalmost annular array of supports 30 at the upper or top end of the plunger assembly 10, as best represented in FIG. 3, also shown in FIGS. 1, 2, 4 and 5. A hollow barrel 24 is threadedly received onto the lower or downwardly facing end of the plunger assembly 10, as represented in FIGS. 1, 2, 3 and 4. The retrieval neck 26 preferably has a threaded bore 29 extending therein which threadedly receives the screw threaded distal end 33 of the central spine or mandrel 12, as represented in FIGS. 2 and 3. In a further embodiment, the retrieval neck 26 may be machined as part of a solid casting with the mandrel 12, and is irremovable therefrom. The hollow lower end barrel 24 has the bore 18 extending therethrough, to permit gaseous fluids to enter the bore 18 within the mandrel 12. The hollow lower end barrel 24 has the bore 18 extending therethrough, to permit gaseous fluids to enter the bore 18 within the mandrel 12. Relative to the retrieval neck 26, spiral grooves 71 may be arranged therein, as shown in FIG. 2, to help rotation of the plunger assembly 10 in its travels in a well. Such a spiral groove arrangement 73 may be formed into the lower end nose 24, as also shown in FIG. 2.

Figure 4:
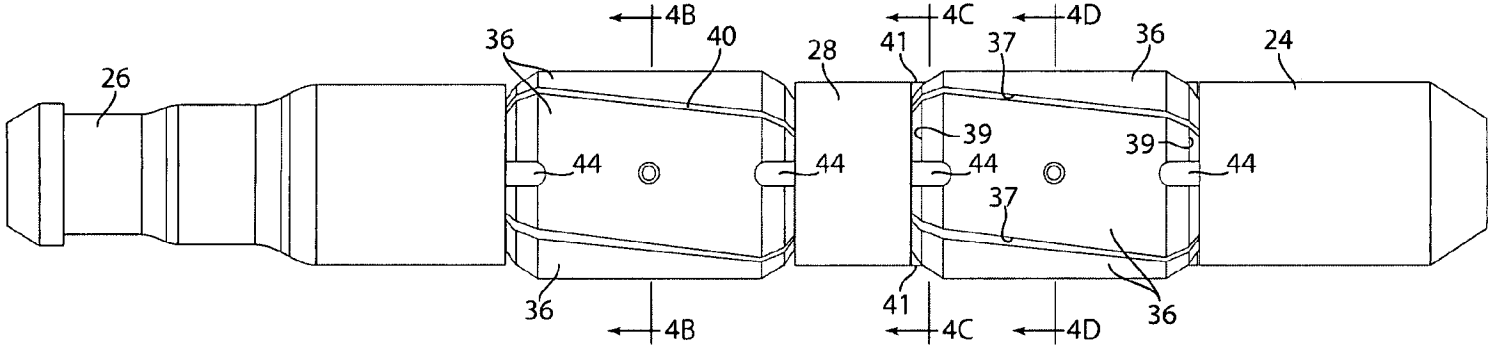
FIG. 4 is a side elevation view of the plunger shown in FIG. 1.
Figure 4D:
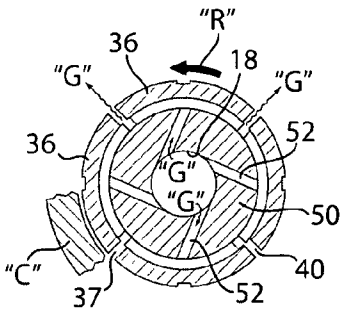
FIG. 4D is a sectional view taken along the lines 4D-4D of FIG. 4.
Figure 4C:
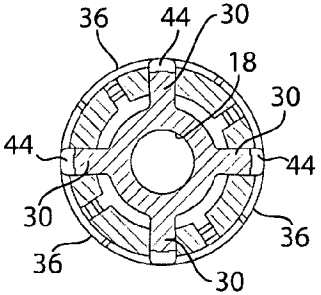
FIG. 4C is a sectional view taken along the lines 4C-4C of FIG. 4.

Relative to the "wear functions" of the plunger assembly 10, the arrangement of, for example, preferably at least two outer-surface-curved sealing-surface wear pads 36, shown in FIGS. 1, 2, 3, 4, 4B, 4C, 4D, 5 and 6, (four being shown) are circumferentially arranged about each mandrel half 20 and 22, so as to be radially slidingly supported adjacent the radially outer end of each radially directed support 30. The outer-surface curved sealing surface pads 36 preferably have four peripheral sides or edges 37 and 39, as shown in FIG. 4, and in one preferred embodiment are of "overall" peripheral shape of a parallelogram configuration, as may be seen in FIGS. 1, 2, 3, especially when viewed from a radially adjacent perspective, as best shown in FIG. 4.

Figure 4B:
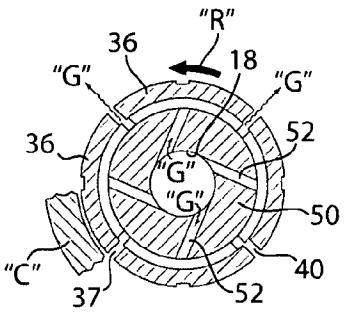
FIG. 4B is a sectional view taken along the lines 4B-4B of FIG. 4.
Figure 5:
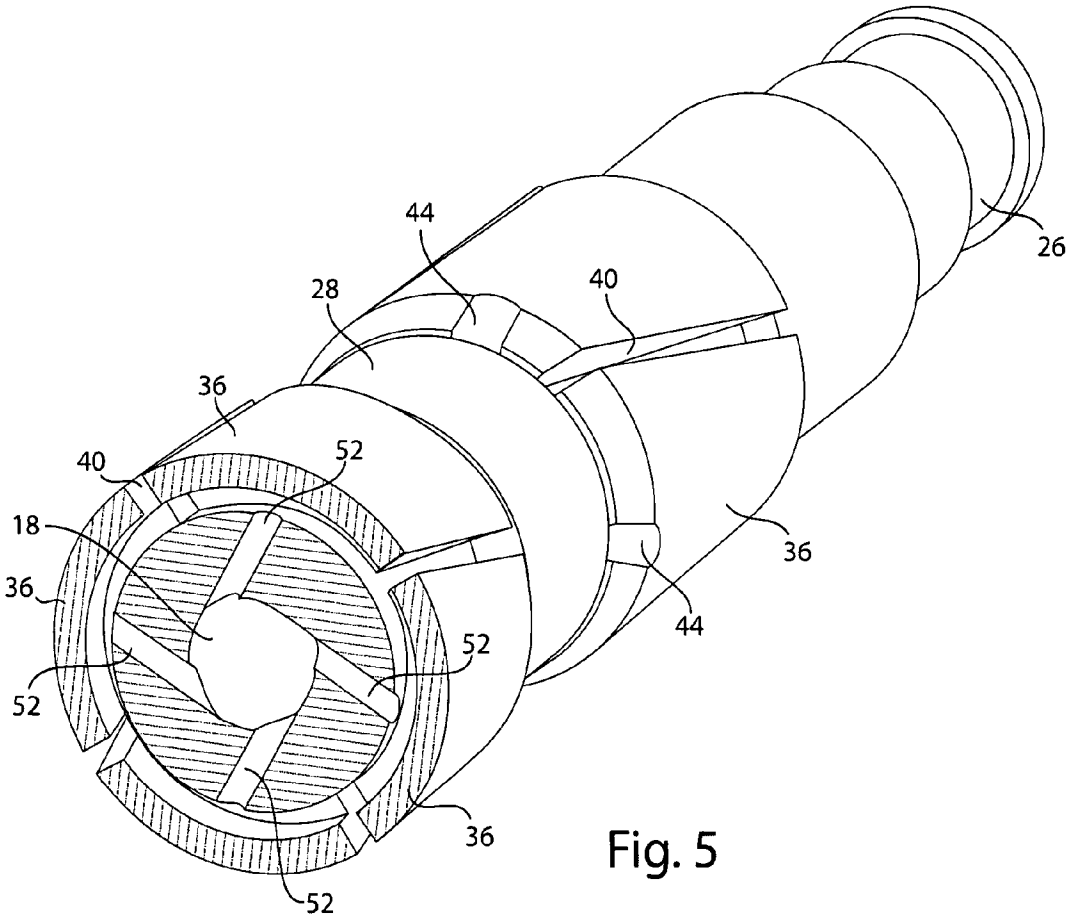
FIG. 5 is a perspective view of a portion of a mandrel of the present invention.
Figure 6:
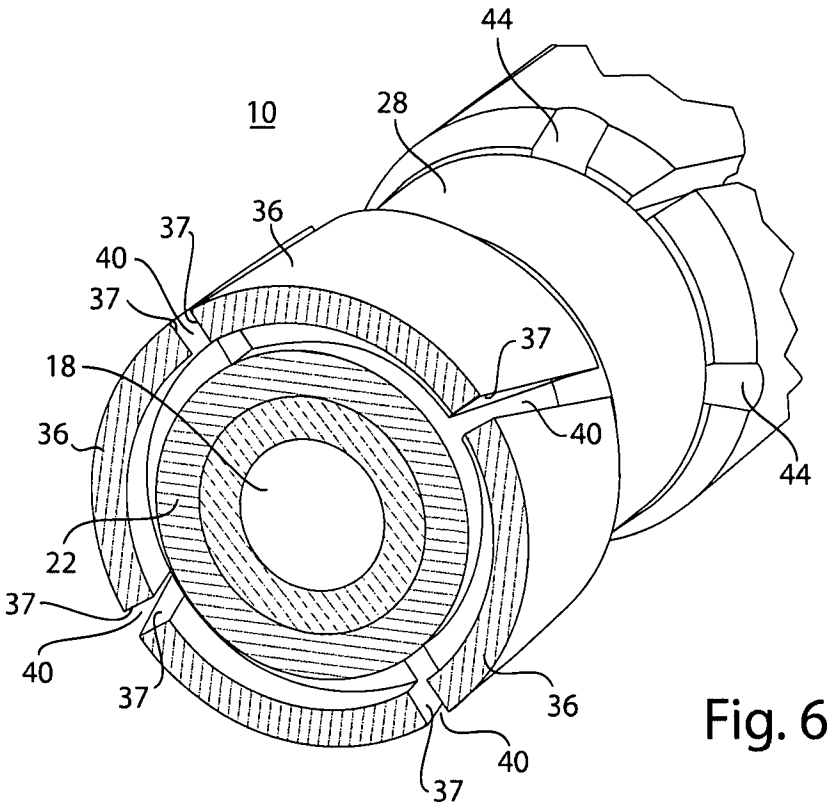
FIG. 6 is a perspective view of a portion of the mandrel and wear pads of the present invention.

The circumferentially adjacent parallelogram configuration sealing-surface wear pads 36 have their long sides 37 adjacent to one another and are slightly spaced apart from one another, as may be seen in FIG. 4B, to thus create a narrow, spin-inducing (to the plunger) spiral gap 40 between one another, as represented in FIGS. 1, 4, 5 and 6.

The curved sealing surface pads in another preferred embodiment are of rectilinear configuration, as shown in our parent '464 application. The curved sealing-surface pads 36 each have a cutout 44 arranged on its longitudinally directed edges, as may be seen in FIGS. 1, 2, 3, 4 and 4C. Each cutout 44 slidingly mates with the radially directed support 30. At least one radial bias spring 46 is arranged between the central spline or mandrel 12 adjacent each radially directed support 30, as may be seen in FIG. 3. The radial bias springs 46 act to radially outwardly bias the curved sealing surface pads 36 against the inner side of the well's conduit "C" in which the split-pad plunger assembly 10 travels. The outward radial bias of the sealing-surface pads 36 acts to minimize loss of pressure from the lower side of that conduit "C" during movement of the plunger therein. The wear pads 36 have an inner nozzle-facing-surface 75, as represented in FIG. 2, which may in another aspect of the present invention, have spiral grooves 77 formed therein, represented in FIG. 2, to facilitate rotation of the plunger assembly 10 in its travels in a conduit "C", that conduit being represented in FIG. 1.

The retainer ring 28 of circumferential shape, is disposed about the mid-point of the central spine or mandrel 12, as shown in FIGS. 1 and 3, and has an annular lip 41 which secures the other or "proximal" longitudinal edge of each curved sealing-surface pad 36 in proper location about the central spine or mandrel 12, as may be seen in FIGS. 3 and 4. The retainer ring 28 is represented in FIG. 2, in a pre-sliding to-the-mandrel mid-point configuration.

An annular manifold 50, which is part of the mandrel, not only directs flow of the gas, but also supports the pads axially/longitudinally, is arranged circumferentially around at least one longitudinal location of preferably both the first half 20 and the second half 22 of the hollow elongated mandrel 12. Each manifold 50 comprises an annular array of fluid discharge conduits and/or nozzles 52 arranged generally tangentially therein, with respect to the longitudinally directed bore 18 within the mandrel 12, as may be seen in FIGS. 4B, 4D and 5. Such tangential orientation of these nozzles 52 thus induces a rotation "R" to the entire plunger assembly 10 when gas "G" from the well is introduced therethrough, as represented by the arrows "R" in FIGS. 4B and 4D.

In yet a further embodiment of the conduits or nozzles 52, those conduits or nozzles 52 may also be slightly rearwardly directed towards the bottom of the plunger assembly 10, in addition to their tangential orientation, as represented in FIG. 3, to provide a slight forward thrust to the plunger assembly 10 upon ejection of the gas "G" therefrom.

The gaseous fluid "G" thus entering the bore in the hollow lower end barrel 24 pressurizably flows into the fluid communicative bore 18 of the mandrel 12, and through the oblique/non-radial/tangential nozzles 52 in the manifold 50, as the plunger assembly travels within the conduit "C" of the well. The jet-like fluid pressure of the well gaseous fluids traveling through the first lower bore 18 in the hollow lower end barrel 24 and into the bore 18 within the elongated mandrel 12 flows tangentially (along with a radial component) outwardly through the channels and nozzles 52 in the manifold 50, angularly against the arcuate inner surface 75 of the pads 36 pushing them against the walls of the conduit "C", while simultaneously inducing rotation "R" to the plunger assembly 10. This outwardly directed bias force thus provides both an angular momentum and an improved sealing of the plunger assembly 10 as it travels through the well's conduit "C". Further, the gaseous fluid escapes radially outwardly from within the plunger assembly 10, as represented in FIG. 4B, and into the conduit "C", keeping liquid from running back downhole via movement under the pads 36, and also helps keep the liquid on the top (above) and ahead of the plunger assembly 10. That escaping gas thus also lightens the liquid load on above the plunger assembly 10, so less pressure is required to provide lift to a given amount of fluid above the plunger assembly. The biasing of the well gas "G" against the curved inside surface of the pads 36 assists the springs 44 in biasing the pads 36 radially outwardly against the conduit "C", thus providing a tighter seal between the plunger assembly and the conduit "C" through which it is moving.

Thus, gaseous fluids "G" enter the lower end of the plunger assembly through the central open channel 18 in the hollow lower end barrel 24 and into the main channel, the bore 18 within the mandrel 12. The gas "G" enters the manifold 50 and exits out the tangentially directed nozzles 52 therein, and jets against the inner surface 75 of the pads 36, biasing them radially outwardly, assisting the bias springs 44 thereby, and assists in providing spin to the plunger assembly 10. The gas "G" then also enters the conduit "C" and floats upwardly therein, lightening the load of the liquid on.

We claim:

1. A plunger assembly arranged to minimize uneven wear spots or areas thereon during the plunger assembly's horizontal and vertical travel within a hydrocarbon producing well conduit, the plunger assembly comprising:

an elongated central mandrel having a bore extending longitudinally therethrough for transmitting gaseous fluids from a well, through the plunger assembly;

a plurality of arcuately shaped wear pads guidably supported on outer portions of the elongated central mandrel; and at least one tangentially directed nozzle arranged to direct gaseous fluids from the bore of the elongated central mandrel against an inner side of at least one of the arcuately shaped wear pads arranged on the outer portions of the elongated central mandrel, wherein the wear pads are of four sided peripheral shape of parallelogram configuration, wherein the wear pads have a gap or space therebetween, and wherein the gap or space between adjacent wear pads defines a spirally shaped opening therebetween.

2. The plunger assembly as recited in claim 1, wherein the wear pads are of four sided peripheral shape of rectilinear configuration.

3. The plunger assembly as recited in claim 1, wherein the at least one tangentially directed nozzle is also of rearwardly directed thrust producing orientation.

4. The plunger assembly as recited in claim 1, wherein the spiral gaps and the conduits or nozzles are arranged to effect a rotation of the plunger assembly about a longitudinal axis thereof in its movement through a well conduit.

5. A method of inducing rotation of a plunger assembly during the plunger assembly's movement through a conduit in a hydrocarbon well, comprising:

arranging an elongated central mandrel having a bore extending longitudinally therethrough for transmitting gaseous fluids from a well, through the plunger assembly;

arranging a plurality of arcuately shaped wear pads guidably supported on outer portions of the elongated central mandrel;

forming at least one tangentially directed conduit or nozzle in the elongated central mandrel, the conduit or nozzle being arranged to direct gaseous fluids from the bore of the elongated central mandrel against an inner side of at least one of the arcuately shaped wear pads arranged on the outer portions of the elongated central mandrel;

arranging the plurality of wear pads on the outside of the elongated central mandrel with adjacently arranged gaps or spaces therebetween; and arranging the gaps or spaces into a spiral configuration with respect to a longitudinal axis of the plunger assembly.

6. The method as recited in claim 5, including:

forming the at least one tangentially directed conduit or nozzle in the elongated central mandrel in a rearwardly direction in addition to its tangential direction.

7. A system for reducing the wear spots on any one of a plurality of wear pads circumferentially arranged on an outer surface of a plunger assembly in a non-vertical oriented hydrocarbon retrieval well operation, the system comprising:

an elongated central mandrel of the plunger assembly having a bore extending longitudinally therethrough for transmitting gaseous fluids from a well, through the plunger assembly;

a plurality of arcuately shaped circumferentially adjacent wear pads guidably supported on outer portions of the elongated central mandrel of the plunger assembly; and at least one tangentially directed nozzle arranged to direct gaseous fluids from the bore of the elongated central mandrel against an inner side of at least one of the arcuately shaped wear pads arranged on the outer portions of the elongated central mandrel, so as to induce a spin or rotation of the plunger assembly about its longitudinal axis and thus reduce wear spots on any one wear pad, wherein the wear pads are of a parallelogram shape having a gap therebetween, and wherein the gap between circumferentially adjacent wear pads is of rotational inducing spiral orientation.

8. The system as recited in claim 7, wherein the at least one tangentially directed nozzle also has a rearward slant or orientation thereto to induce thrust as well as rotation into the plunger assembly.

9. The system as recited in claim 7, wherein any gas from the at least one nozzle escapes from the plunger assembly by passage between the adjacent spaced apart wear pads.

10. A system for minimizing uneven wearing of an annular array of radially displacable wear pads arranged about an elongated, central, hollow-bore gas-transmitting mandrel of a plunger assembly as that plunger assembly travels through a conduit in a hydrocarbon recovery well, the system comprising:

at least one gas ejection conduit obliquely arranged between the hollow bore of the central mandrel and an outer surface thereof so as to eject gaseous fluids onto an inner surface of at least one wear pads, so as to bias that at least one wear pad outwardly, and to induce rotation of the plunger assembly within the conduit of the well, wherein the annular array of radially displacable wear pads have a gap therebetween to permit gas from the gas ejection conduit to escape outwardly of the plunger assembly, to lighten any load of fluid ahead of the plunger assembly within the conduit of the well.

11. The system as recited in claim 10, wherein the gas ejection conduit is arranged tangentially with respect to the hollow-bore gas-transmitting mandrel.

12. The system as recited in claim 10, wherein each wear pad in the annular array of wear pads has the shape of a parallelogram.

13. The system as recited in claim 10, wherein at least one of the wear pads is of tapering thickness in its circumferential direction.

14. The system as recited in claim 10, wherein the inner surface of at least one of the wear pads has spiral grooves arranged therein to facilitate gaseous movement and support plunger rotation.

* * * * *